United States Patent [19]

Tollar

[11] Patent Number: 4,564,063

[45] Date of Patent: Jan. 14, 1986

[54] ANNULAR HEAT EXCHANGER

[75] Inventor: James E. Tollar, Midland, Mich.

[73] Assignee: The Dow Chemical Company, Midland, Mich.

[21] Appl. No.: 600,935

[22] Filed: Apr. 16, 1984

[51] Int. Cl.[4] ..... F28F 13/12; B01F 15/06

[52] U.S. Cl. ..... 165/109.1; 165/165; 366/144; 366/149; 366/303

[58] Field of Search ..... 165/109 R, 165; 366/144, 147, 149, 303, 304

[56] References Cited

U.S. PATENT DOCUMENTS

| | | | |
|---|---|---|---|
| 933,558 | 9/1909 | Hawes | 165/109 R |
| 1,284,945 | 11/1918 | Swan | 366/149 |
| 1,662,478 | 3/1928 | Schubert | 366/147 |
| 2,367,279 | 1/1945 | Houlton | 366/147 |
| 3,280,899 | 10/1966 | Brasie | 165/109 R |
| 3,592,609 | 7/1971 | Honbo | 366/149 |
| 3,788,609 | 1/1974 | Toczyski | 366/303 |
| 4,472,061 | 9/1984 | Mansour | 366/149 |

FOREIGN PATENT DOCUMENTS

| | | | |
|---|---|---|---|
| 739906 | 11/1955 | United Kingdom | 165/109 R |
| 1304257 | 1/1973 | United Kingdom | 366/304 |

*Primary Examiner*—William R. Cline
*Assistant Examiner*—John K. Ford
*Attorney, Agent, or Firm*—R. B. Ingraham

[57] ABSTRACT

A devolatizing heat exchanger having an annular body with an open end and a closed end. Axially extending heat exchange fluid conduits are axially disposed and radial product conduits are disposed in the annular body. A mixing chamber is enclosed within the annular heat exchanger discharging adjacent the enclosed end therof, the annular heat exchanger being enclosed within a jacketed vessel.

6 Claims, 6 Drawing Figures

ANNULAR HEAT EXCHANGER

A variety of heat exchangers are known in the art. One variety of heat exchanger that has been particularly useful for handling viscous materials is a so-called flat plate heat exchanger such as is disclosed in U.S. Pat. No. 3,014,702. A variety of this heat exchanger adapted as a chemical reactor is shown in U.S. Pat. No. 3,280,899. Other variations of the flat plate heat exchanger are disclosed in U.S. Pat. No. 4,423,767. In the use of heat exchangers, particularly with viscous materials, it is oftentimes desirable to admix a relatively low boiling material with the viscous stream and subsequently subject the stream to subatmospheric pressure in order to reduce volatiles to a minimal level. Oftentimes in such a process it is desirable to have a relatively high pressure drop across the heat exchange member. As the size of heat exchangers increases, the known flat plate technique becomes increasingly difficult to fabricate in a satisfactory manner to provide units of sufficient size and to contain the desired pressure.

It would be desirable if there were available an improved heat exchanger for handling of viscous materials.

It would also be desirable if there were available a heat exchanger for viscous materials which was capable of operating with a relatively high pressure drop across the heat exchange surfaces.

It would also be desirable if there were available an improved heat exchanger which was readily fabricated.

These benefits and other advantages are achieved in a heat exchanger, the heat exchanger comprising a generally annular body having a first closed end and a second open end, the annular body having generally axially extending heat exchange fluid conduits generally uniformly annularly disposed, a plurality of generally radial conduits disposed in the annular wall, providing communication between an inside space defined by the annular wall and space external to the annular wall, the radial passageways having a length to diameter ratio of at least 4, beneficially 10 and advantageously 20.

Further features and advantages of the present invention will become more apparent from the following specification taken in connection with the drawing wherein FIG. 1 is a schematic sectional view of a heat exchanger in accordance with the present invention adapted to be utilized as a devolatilizer for viscous liquids;

Figure 1:
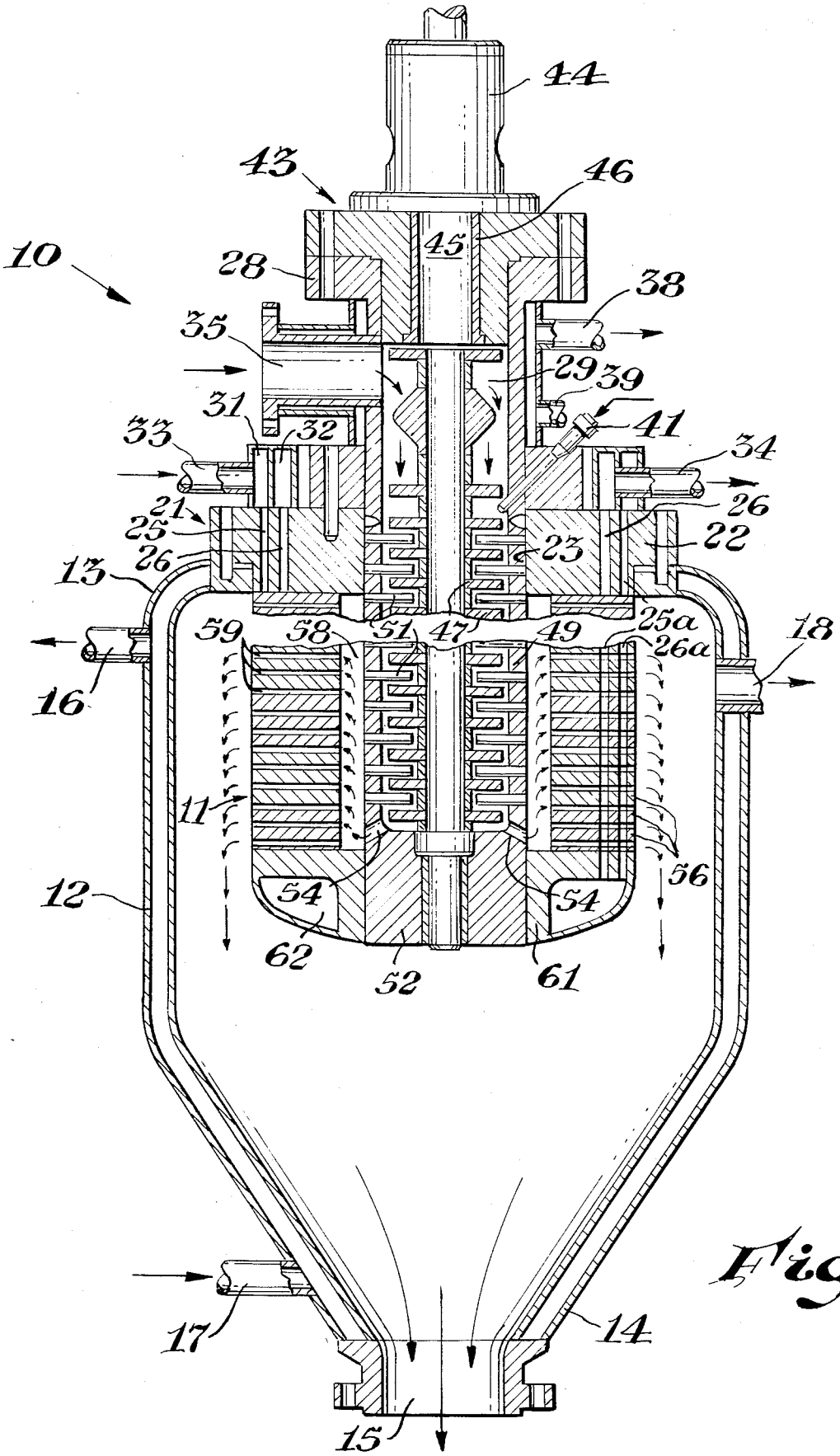

In FIG. 1 there is depicted a sectional view of a devolatilizer 10 having incorporated therein a heat exchanger in accordance with the present invention generally designated by the reference numeral 11. The devolatilizer 10 comprises a jacketed vessel 12. The vessel 12 is generally of cylindrical configuration having an upper end 13 carrying the devolatilizer heat exchanger 11 and a generally frustoconical or hopper bottom 14 having a material discharge opening 15 formed therein. The jacketed vessel 12 has heat exchange fluid connections 16 and 17 providing ingress and egress for heat exchange fluid to the jacket of the vessel. Adjacent the top or upper end 13 of the vessel 12 is a volatile outlet port 18. The heat exchanger 11 comprises a header assembly 21. The header assembly 21 comprises a first flange member 22 directly affixed to the vessel 11. The flange member 22 defines a generally cylindrical cavity 23 coaxially disposed therein. The flange 22 defines a first series of generally axially extending conduits or passageways 25, the passageways 25 being generally axially parallel to the axis of the vessel 12 and the axis of the heat exchanger 11 and of generally cylindrical configuration. Within the series of passageways 25 is disposed a second series of conduits or passegways 26 extending generally parallel to and of similar configuration of the passageways 25. Disposed on the flange 22 is a heat exchange fluid and material receiving header generally designated by the reference numeral 28. The header 28 is generally of a spool-like configuration defining an internal generally cylindrical cavity 29. The cavity 29 is generally coaxial with the vessel 12. The header 28 defines a first annular plenum 31 which is in communication with the passageways 25 and a second annular plenum 32 which is in communication with passageways 26. The plenum 31 has a supply passage fitting 33 and a second or discharge passage 34 in communication with the passageways 26. The header 28 has a material supply passage 35 in operative communication with the cylindrical cavity 29. The header 28 and the portion of the header 28 defining the passage 35 are jacketed and have connections for external supply of heat exchange fluid 38 and 39. The header 28 has a conduit fitting 41 which provides communication between space external to the header 28 and the cylindrical space 29. Affixed to the header 28, remote from the vessel 12 is an agitator assembly 43. The agitator assembly 43 has supported thereon an agitator drive means 44. The agitator drive means 44 carries an agitator shaft 45 rotatable within a bearing 46. The agiator shaft 45 extends downwardly toward the bottom 14 of the vessel 12 and has affixed thereto a plurality of generally planar agitator member of blades 47. The blades 47 extend generally radially outward from the shaft 45. Affixed to the first flange member 22 is a hollow cylinder 49. The cylinder 49 has a plurality of radially inwardly projecting pins 51 interdigitated with the blades 47. The cylinder 49 remote from the flange 22 terminates in a bearing block 52 which carries the terminal end of shaft 45 remote from drive means 44. A plurality of passageways 54 are defined by the cylinder 49 at a location remote from the flange 22 and adjacent the bearing block 52. The cylinder 49 is surrounded by a plurality of annular plates 56. The plates 56 are generally coaxially disposed relative to the cylinder 49 and extend a distance generally coextensive with the adjacent hollow portion of the cylinder 49. The plates 56 are rigidly affixed to each other and contain heat exchange fluid conduits of passageways **25*a* and 26*a* which are in communication with the passageways 25 and 26 respectively. The plates 56 and the cylinder 49 define a generally annular space 58 therebetween. The plates 56 define a plurality of radially extending generally cylindrical passageways designated by the reference numeral 59. The passageways 59 provide communication between the space 58 and space external to the annular plates. The annular plates 56 in effect provide a generally annular wall with a plurality of radially extending passageways 59 generally uniformly distributed therethrough. The annular wall formed by the plates 56 terminates remote from flange 22 in a terminal header assembly 61. The header assembly 61 is affixed to bearing block 52 and has defined therein an annular plenum 62 which is in communication with passageways 25 and 26**.

Figure 2:
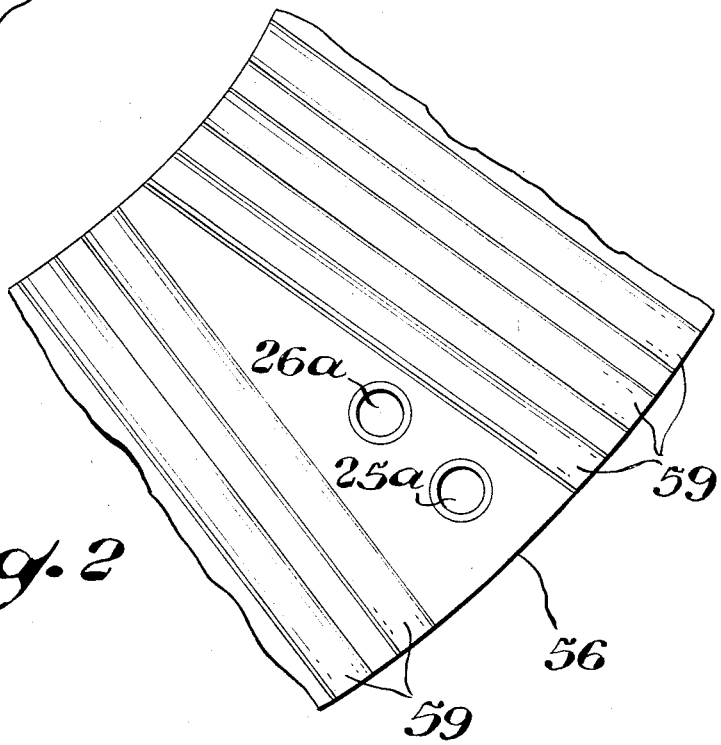
FIG. 2 is a fractional sectional view of the radial passages and heat exchange passages of the heat exchanger of FIG. 1.

In FIG. 2 there is a fractional sectional schematic representation of a portion of a plate 56 depicting the generally radial passageways 59 and the heat transfer fluid passages **25*a* and 26*a***.

Figure 3:
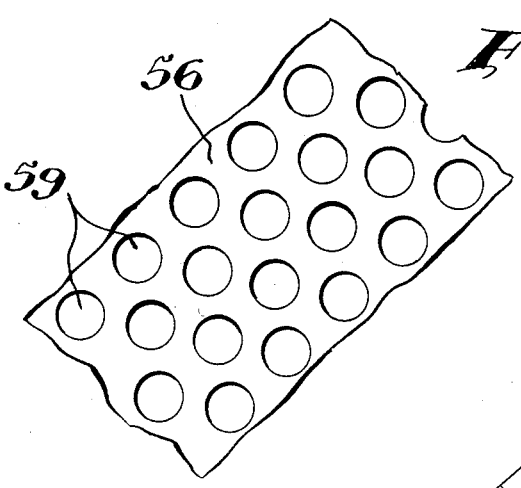
FIG. 3 is a fractional sectional view of a portion of the inner surface of the annular heat exchange member of FIG. 1.

In FIG. 3 there is a fractional sectional view of a portion of a plate 56 when viewed from its axis of generation depicting the arrangement of the passageways 59.

Figure 4:
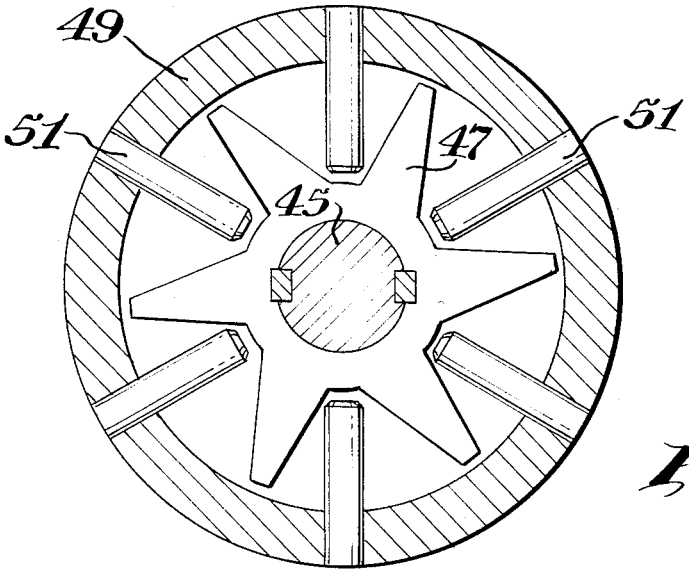
FIG. 4 is a fractional partly in section view looking downwardly at the mixer employed with the heat exchanger in FIG. 1.

In FIG. 4 there is a representation of a cross section of cylinder 49 showing the location of the pins 51 which are radially inwardly extending, agitator shaft 45 and an associated star shaped blade 47.

In operation of the apparatus as depicted in FIGS. 1–4, heat exchange fluid is supplied to fitting 33 which flows into plenum 31 through the passageways 25 and **25*a* through the plates 56 into plenum 62; from plenum 62 through passageway 26*a*, from passageway 26 into plenum 32 and flows out of passageway 34. Appropriate heat exchange fluid is also supplied to connections 38 and 39 as well as connections 16 and 17. Material to be devolatilized enters through fitting 35, flows downward in cavity 29 and, if desired, an appropriate stripping agent is injected through fitting 41. The mixture is then mixed as it passes downwardly over the agitator having blades 47 and past the pins 51. The material flows through cylinder passageways 54, only 2 shown, into the annular space 58 and radially outwardly through the passageways 59. Volatile materials are removed through the port 18, advantageously accomplished at subatmospheric pressures, the nonvolatile material falls to the bottom of the vessel and is discharged through opening 15**.

Advantageously heat exchanges in accordance with the present invention are readily fabricated using conventional materials. Desirably plates such as the plates 56 are made from a material having relatively high conductivity such as aluminum, provided the material being treated is not corrosive.

Figure 5:
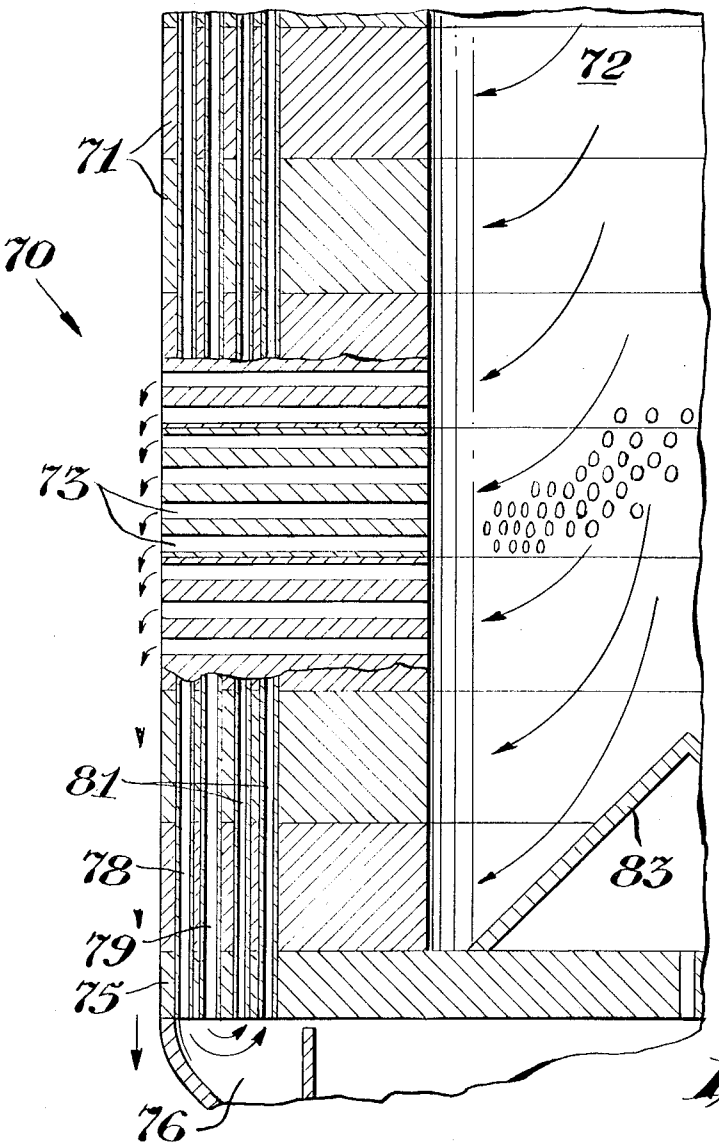
FIG. 5 is a fractional sectional view of an alternate embomiment of the present invention.

In FIG. 5 is depicted a schematic fractional sectional view of an alternate embodiment of the invention generally designated by the reference numeral 70. A plurality of annular plates 71 of equal dimension are coaxially arranged. The plates 71 each defines a generally cylindrical opening 72 centrally disposed and coaxial with the annular plates. The annular plates 71 define radially extending passageways 73. The passageways 73 provide communication between the cylindrical space 72 and space external to the annular plates 71. The generally cylindrical configuration formed by the annular plates 71 is terminated at a lower end with a heat exchange fluid header designated by the reference numeral 75. The header 75 defines a heat exchange plenum 76 which is in communication with a first pair of heat exchange fluid tubes 78 and 79 which are generally peripherally disposed in the plates 71 and have longitudinal axes parallel to the axis of generation of the annular plates 71. A second pair of tubes 81 and 82 are radially inwardly disposed from the tubes 78 and 79 and provide a passage for heat exchange fluid. A conical baffle 83 is disposed on the header 75. The conical baffle has its major diameter adjacent the header 75 and its point within space enclosed by the plates 71. The baffle 83 serves to promote desirable flow pattern within the heat exchanger and prevent the occurrence of what is referred to as dead spots.

Figure 6:
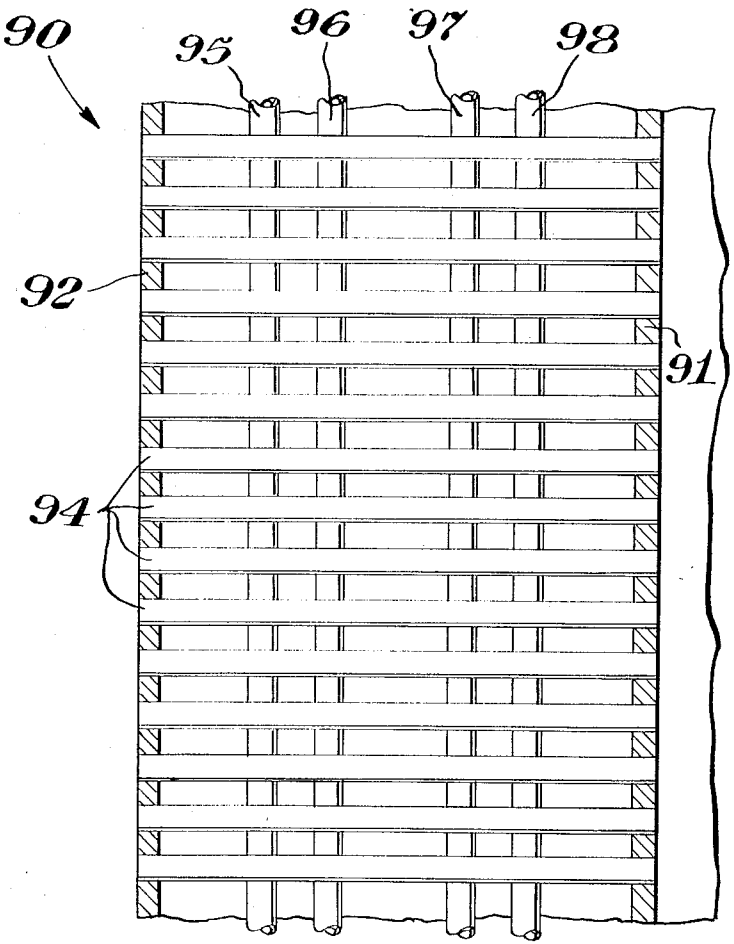
FIG. 6 depicts a fractional sectional view of another embodiment of the invention.

In FIG. 6 there is depicted a fractional sectional representation of a wall of a heat exchanger in accordance with the present invention generally designated by the reference numeral 90. The wall 90 comprises a first or inner annular member 91, and a second or outer annular member 92. Vertically extending tubes 95, 96, 97, and 98 serve to supply heat transfer fluid to the bottom of the heat exchanger where it is discharged into the space between walls 91 and the tubes 94.

Heat exchangers in accordance with the present invention are eminently suited for the handling of viscous liquids wherein a relatively high pressure drop exists across the heat exchange surfaces. The heat exchanger of the present invention is also desirably employed for the devolatilization of viscous polymer masses.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A devolatizing heat exchanger, the heat exchanger comprising a generally annular body having a first axially closed end and a second open end, the annular body having a generally annular wall and generally axially extending heat exchange fluid conduits generally uniformly axially disposed, within the body a plurality of generally radial conduits disposed in the annular wall, providing communication between an inside space defined by the annular wall and space external to the annular wall, the radial passageways having a length to diameter ratio of at least 4, the heat exchanger being disposed within a jacketed vessel having heat exchange fluid connections providing ingress and egress for a heat exchange fluid to a jacket of the jacketed vessel, the jacketed vessel having an upper end and a lower end, a volatile outlet port disposed between the upper and lower ends, the volatile outlet port providing communication between space internal to the jacketed vessel and space external thereto, a material discharge port at the lower end of the jacketed vessel, a header assembly directly affixed to the upper end of the jacketed vessel, the header assembly being of generally cylindrical configuration, the header assembly being partially disposed within and coaxial with the annular heat exchanger and partially external to the jacketed vessel, the header defining a generally cylindrical cavity within the header adjacent the heat exchanger, said cavity being generally coaxial with the heat exchanger, an annular space between the heat exchanger annular wall and header assembly defined by the heat exchanger and header assembly, a material supply passage defined by the header assembly disposed external to the jacketed vessel, the material supply passage being in communication with the header generally cylincrical cavity, the generally cylindrical cavity being in coummunication with the annular space between the heat exchanger and the header assembly at a location remote from the material supply passage and generally adjacent the first axially closed end of the generally closed body, a plurality of pins disposed within the cylindrical cavity of the header assembly, the pins extending generally radially inward, and a rotatable agitator rotatably disposed within the cylindrical cavity, the agitator having a plurality of blades adapted to interdigitate with the pins.

2. The devolatizing heat exchanger of claim 1 wherein the length to diameter ratio is at least 10 to one.

3. The devolatizing heat exchanger of claim 1 wherein the length to diameter ratio is at least 20 to one.

4. The devolatizing heat exchanger of claim 1 wherein the generally annular body is a plurality of generally annular plates disposed in adjacent generally coaxial relationship.

5. The devolatizing heat exchanger of claim 1 wherein the radial conduits are of generlly cylindrical configuration.

6. The heat exchanger of claim 1 wherein the agitator blades are generally planar and of a star shaped configuration.

* * * * *